United States Patent [19]

Neal

[11] 4,311,274

[45] Jan. 19, 1982

[54] MOBILE APPARATUS FOR SPRAYING PROTECTIVE COATINGS

[76] Inventor: W. Harold Neal, Rt. 10, Carrollton, Ga. 30117

[21] Appl. No.: 942,399

[22] Filed: Sep. 14, 1978

[51] Int. Cl.[3] ..... B05B 9/00

[52] U.S. Cl. ..... 239/1; 239/144; 239/172; 239/575; 404/92; 404/111

[58] Field of Search ..... 239/127, 142, 144, 172, 239/575, 146, 147; 404/111, 113, 115, 92; 210/416 R; 366/22–25

[56] References Cited

U.S. PATENT DOCUMENTS

| | | | |
|---|---|---|---|
| 962,728 | 6/1910 | Ward | 239/142 |
| 1,442,787 | 1/1923 | Scheminger | 210/416 R X |
| 1,698,015 | 1/1929 | Fitzgerald | 239/146 X |
| 2,123,156 | 7/1938 | Jagoe . | |
| 2,477,404 | 7/1949 | Butt | 210/416 R X |
| 3,203,631 | 8/1965 | Jutila | 239/142 X |
| 3,279,337 | 10/1966 | Weaver | 239/172 X |
| 3,421,694 | 1/1969 | Müller | 239/142 |
| 4,073,152 | 2/1978 | Kishitani | 404/111 X |

*Primary Examiner*—Richard A. Schacher

*Attorney, Agent, or Firm*—Jones, Thomas & Askew

[57] ABSTRACT

Disclosed herein is an improved, self-contained and portable machine adapted to efficiently spray viscous sealing fluids, which may contain suspended solid matter, onto an unprotected surface. For example, especially suitable for spraying coal tar pitch emulsions containing sand onto asphalt surfaces. Said machine comprising a mobile frame supporting a reservoir tank, having a mechanical agitation therein, and a fluid spraying means coupled by an improved fluid pumping assembly which includes a plurality of selectively controlled valves and attached conduits which direct the fluid through a pump and filter to and from the tank and spray means as desired.

4 Claims, 3 Drawing Figures

MOBILE APPARATUS FOR SPRAYING PROTECTIVE COATINGS

BACKGROUND OF THE INVENTION

This invention relates to fluid spraying apparatus and more particularly to an improved, self-contained machine adapted to efficiently spray viscous sealing fluids, containing suspended solid material, onto an asphalt surface.

A good asphalt pavement seldom wears out but it is destroyed by external factors. As soon as a freshly laid hot mix pavement begins to cool it also begins an aging process which will eventually destroy the asphaltic binder and reduce the pavement to a layer of loose stone. The binder undergoes chemical reactions with the oxygen in the air and water or other liquids on the surface. At first this process is necessary for the pavement to become hard and firm but if the process is not arrested complete deterioration of the binder can take place. Sealing the pavement after the curing period can protect the asphalt from these destructive forces and can provide even a weak pavement with a much longer useful life.

There are several types of sealing agents and several methods used to seal asphaltic pavement. Two of such agents which are widely used in sealing and finishing asphalt surfaces such as parking lots, drive ways, and the like, are Asphalt Emulsions and Coal-tar-pitch emulsions. Two common methods used to apply these agents are either squeeging the fluid over the surface or spraying the fluid onto the surface. Each combination of method and agent has its own particular advantages and disadvantages.

For example, spraying machines are simple to maintain and easy to use but most require that the fluid be free of solids and diluted considerably for proper spray characteristics.

Squeeging machines can apply undiluted sealant containing sand or other solid fillers but have a high initial cost and require a high degree of maintenance because of the severe wear of the spreading and brushing components.

Asphalt emulsion type sealing material is generally made up of an asphalt emulsion, fine silica sand, and sometimes other selected fillers such as asbestos. This type of sealing is used where low cost is necessary. However, they are not resistant to oil, gasoline, or other petroleum fuels. They do fill small voids in asphalt pavement and form a relatively smooth but skid resistant surface which protects the subsurface from harmful effects of sun, water, and frost. They are applied by a hand squeegee or mechanical squeegeing means well known in the art. One example of a suitable mechanical squeegee type machine is the Seal-Mor model SM-175, manufactured by Neal Mfg. Co. of Villa Rica, Ga., which can apply the same amount of material as 8 or 10 men could using hand squeegees or about 150,000 sq. ft. per day. Another of this type is disclosed in U.S. Pat. No. 3,279,337.

Coal-tar-pitch sealing is a more widely accepted material for sealing bituminous pavements because it seals in the natural asphalt oils while preventing damage by oils, gasoline and most other petroleum fuels while also protecting against the harmful effects of sunlight, rain, and road salts. The composition of coal-tar pitch emulsions is exemplified by Federal Specification R-P-335d which indicates that a typical sample should contain at least 47% nonvolatile organics and up to 54% water so as to yield a specific gravity of at least 1.20. Usually the emulsion must be diluted with additional water, from 7 to 20% prior to use so that the material may be applied in a uniform thin coating onto the asphalt pavement.

Similar spraying machines have been developed, for example the type disclosed in U.S. Pat. No. 962,728 or 3,858,761, but are of limited use commercially because of numerous disadvantages. Usually the prior art provides a tank and a spray means coupled by a gear-type, positive displacement pump which provides fluid at a high flow rate and sufficient pressure only when the fluid is diluted so as to have a relatively low viscosity. Typically sealants are diluted 50% or more with water. This high amount of dilution renders prior art spraying machines less efficient than the squeegee-type machines which typically can apply an emulsion diluted with only 10 to 20 percent water.

Another disadvantage with prior art spraying machines is their inability to apply fillers such as sand along with the sealer. It is necessary to spray the sealer onto the pavement then apply the sand separately, usually by hand, which results in non-uniform coverage.

SUMMARY AND OBJECTS OF THE INVENTION

Accordingly, it is a general object of the present invention to provide an improved portable machine adapted to efficiently spray viscious sealing fluids onto unprotected surfaces.

More particularly, the invention has an object to provide such an improved sealant spraying machine capable of spraying fluids containing suspended solid particles.

An additional object is to provide apparatus of this character which is of simple, efficient, durable, and relatively inexpensive construction and wherein its several parts are readily accessible for adjustment, repair or replacement.

Now in order to implement these and still further objects of the invention, which will become more readily apparent as the description proceeds, the apparatus aspects of this development are manifested by the features that include an improved arrangement of pipes and valves for controlling the flow of sealing material to and from tank and to spraying apparatus. More specifically, the invention includes motor-pump assembly and a large reservoir tank mounted on a portable support for transporting the apparatus from site to site. The pump assembly can be used to fill the mixing tank from a main storage tank or from barrels at the job site. The sealant material is then mixed with the proper amount of water, and sand if desired, in the tank which contains a mechanical mixing device. The sealant which may then contain suspended sand, is pumped from the mixing tank through a filter canister located immediately prior to the pump inlet, to the outlet manifold where the fluid can be diverted to the spraying head or bypassed back into the tank. An additional pipe is attached to the pump outlet manifold so that the fluid may be pumped to an external reservoir if it is desired to empty the mixing tank of any unused sealant at the completion of a job.

BRIEF DESCRIPTION OF THE DRAWINGS

While the specification concludes with claims, particularly pointing out and distinctly claiming the subject matter which is regarded as the present invention, it is believed that the invention, objects, features, and advantages thereof will be better understood from the following detailed description taken in connection with the accompanying drawings in which:

Similar reference characters refer to similar parts throughout the several views of the drawings.

DESCRIPTION OF THE PREFERRED EMBODIMENT

Figure 1:
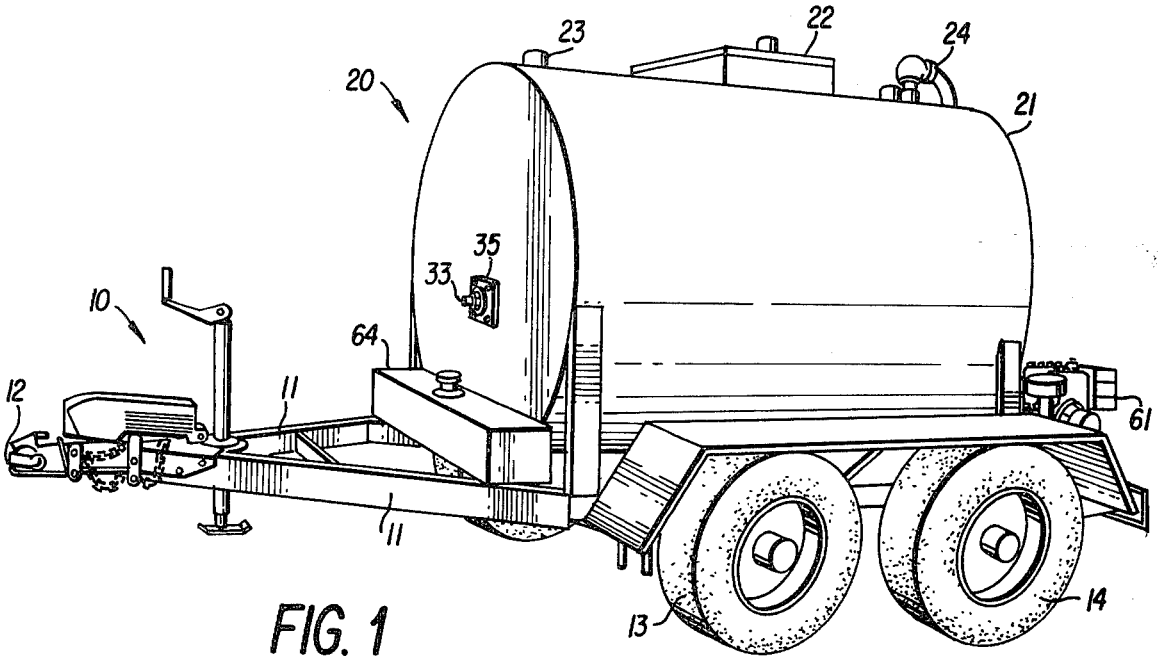
FIG. 1 is a side view of the machine of the present invention, generally illustrating the reservoir tank mounted on typical mobile support means.

As illustrated in the drawings, the fluid spraying apparatus of the present invention comprises, generally, a portable support means 10, sealing-fluid reservoir 20, mechanical agitator assembly 30, spraying means 40, a sealing-fluid pumping assembly 50, and a hydraulic system 60.

In more detail, portable support means 10 comprises at least two support rails 11 which may advantageously be arranged on two sets of wheels 13 and 14 mounted in tandem on a pair of axels (not shown) resiliantly affixed to rails 11. A means 12 for coupling the support rails 10 to a propelling vehicle (not shown) may be provided as illustrated in FIG. 1. However, support rails 11 may alternately be directly placed in the bed of a truck or other motorized vehicle thereby eliminating the need for wheels 13 and 14.

The sealing-fluid reservoir 20 comprises a cylindrical tank 21, typically holding about 550 gallons, mounted on support rails 11 having a covered access portal 22 adapted to alloy entry into the tank for cleaning or repair. Portal 22 also allows sand to be added into tank 21 when desired. Tank 21 preferably has a vent pipe 23 in its upper surface and a removable drain plug (not shown) in its lower surface to permit emptying of the tank for cleaning when necessary. Tank 21 is connected to the fluid pumping assembly by two conduits; a fluid return line 24 in the upper surface and a fluid supply line 25 (shown in FIG. 3) located in the lower surface, both of which are more fully described hereinafter.

Figure 2:
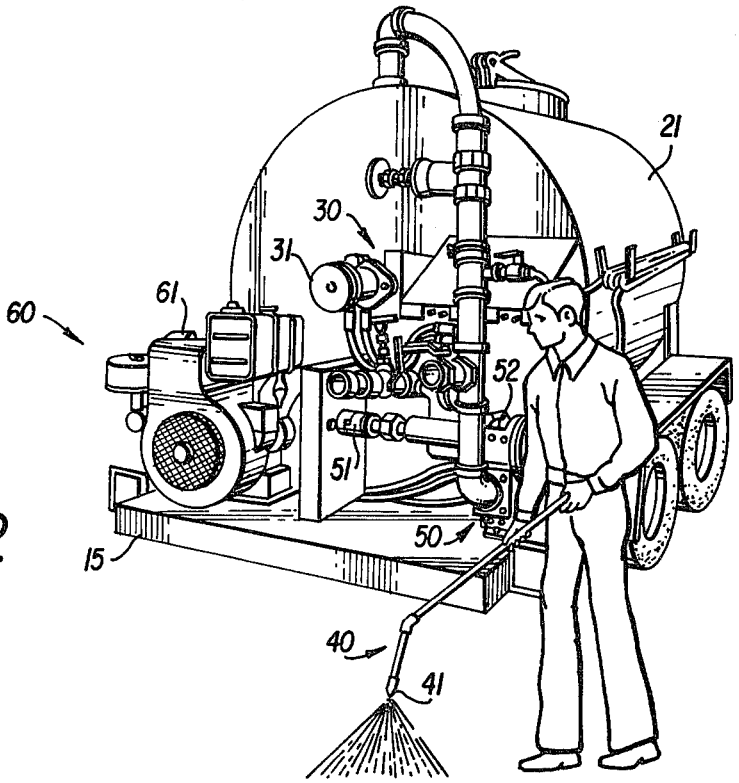
FIG. 2 is a rear view of the machine of the present invention illustrating the location of the fluid pumping assembly and a typical spray means.
Figure 3:
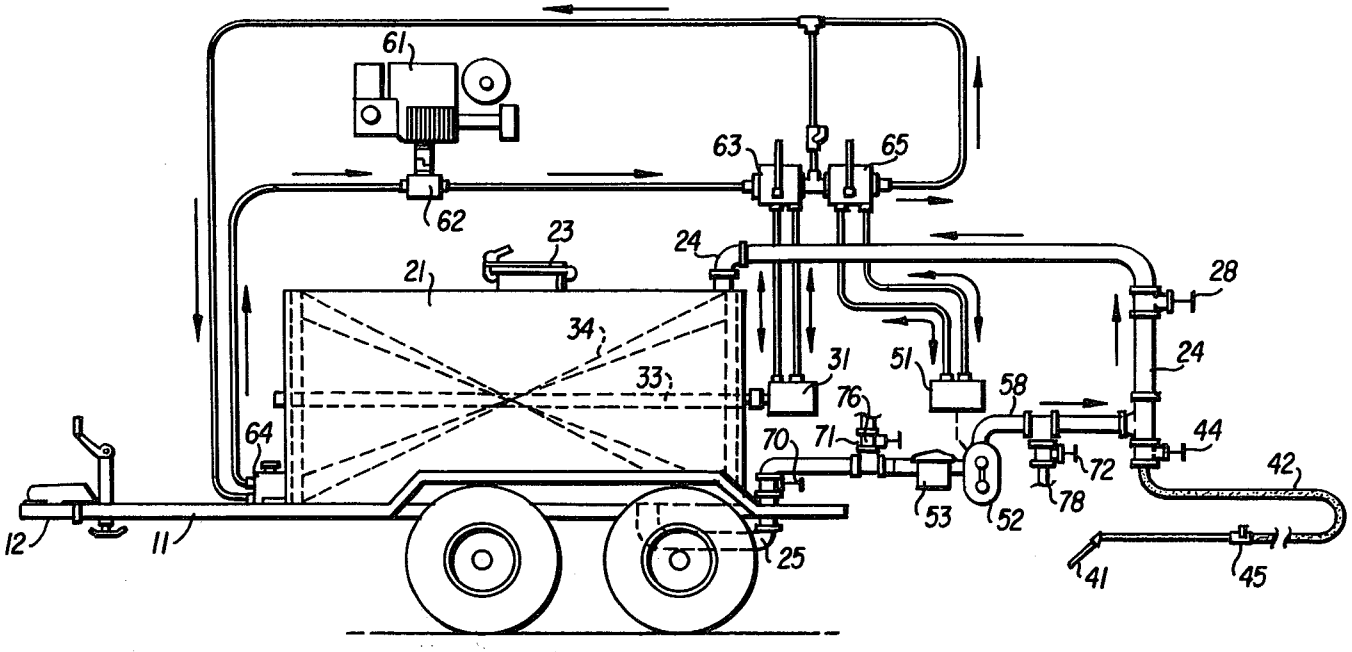
FIG. 3 is a schematic of the fluid pumping assembly illustrating the relationship of the various components thereof.

Agitator assembly 30 comprises a paddel assembly 34, illustrated by phantom lines in FIG. 3, located inside of tank 21 and connected to drive means 31 by a shaft 33 extending through sealed bearings 35 in the wall of tank 21. It is preferred that drive means 31 is suitably regulated so that the shaft 33 turns at a rate of only a few revolutions per minute. Drive means 31 may be a conventional gasoline fueled engine, electric motor, or may be advantageously a hydraulicly powered motor as illustrated in FIG. 2.

The sealing-fluid pumping assembly, generally indicated as 50 in FIG. 2, is mounted adjacent tank 21 on a platform 15 supported by rails 11 and comprises hydraulic motor 51 driving sealant pump 52 which is connected to filter 53 and to various conduits and valves which control the flow of fluid from tank 21 to spraying means 40.

The hydraulic system, generally indicated as 60 in FIG. 2, is also mounted on platform 15 for convenience but may alternately be mounted elsewhere on the support means since it merely supplies controlled hydraulic power to hydraulic motors 31 and 51 described elsewhere. The hydraulic system comprises a gasoline fueled engine 61 of about sixteen horsepower driving a hydraulic pump 62 which forces hydraulic fluid from a small reservoir 64 through control valves 63 and 65 to the aforementioned motors 31 and 51 respectively.

Returning now to the sealing-fluid pumping assembly, which is schematically illustrated in FIG. 3, it can be seen that sealing fluid flows from the bottom of tank 21 through conduit 25 to valve 70 which may be closed to isolate tank 21 from pump 52 so that fluid may, if desired, by drawn from any external source (now shown) through connection 76 and valve 71. Normally, however, valve 71 is closed and 70 is open so that fluid is drawn from the tank. In either mode, fluid is drawn into filter 53 which may be of any conventional design having a perforated screen to prevent large solid objects from entering and damaging pump 52. It has been found that it is important that filter 53 be connected immediately adjacent pump 52 by a short, large diameter (about 2") conduit 57 and that the internal volume of filter 53 be at least one gallon, and preferably 2 to 3 gallons which acts to prevent cavitation in the pump. It is believed that the internal volume of filter 53 should be at least two percent of the per minute flow rate of pump 52 in order to prevent cavitation when pumping common sealing fluids. From pump 52 fluid is forced, under pressure, through conduit 58 to a junction with conduits 24 and 42. Fluid flow through each of conduits 24 and 42 is controlled by valves 28 and 44, respectively depending upon the desired result. In addition, fluid may be transferred to an external receptacle (not shown) through connection 78 by opening valve 72 and closing valves 44 and 28. However, normally valve 72 is closed and fluid is forced through conduit 42 to the spray means 40. The volume of fluid flowing to the spray means is controlled by valve 44 while the pressure of the fluid in conduit 42 is controlled by valve 28 which may be partially opened to allow a portion of the fluid to return to tank 21 through return conduit 24.

Spraying means 40 can be of any conventional design such as a single fluid spraying nozzle 41 adapted to be held and guided by hand or it may be a plurality of spray nozzles mounted on a manifold attached to the rear of platform 15 and adapted to spray fluid across the entire width of the machine as it is towed behind a vehicle. Advantageously, another valve 45 may be located such that an operator may also control the flow of sealing fluid without returning to the machine.

While the invention has been illustrated and described as embodied in an arrangement for sealing asphalt pavement, it is not intended to be limited to the details shown, since various modifications and structural changes may be made without departing in any way from the spirit and scope of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed is:

1. A method of sealing pavement by applying asphalt or coal-tar-pitch emulsions containing suspended sand, comprising the steps of:

agitating said emulsion containing suspended sand in a reservoir to maintain said sand in suspension;

filtering said emulsion containing suspended sand through a high volume filter selected to pass said suspended sand and to block objects larger than said suspended sand; and pumping said emulsion containing suspended sand under pressure through a spray nozzle onto a paved surface.

2. An apparatus for spraying asphalt or coal-tar-pitch emulsions containing suspended sand, comprising:

a reservoir containing said emulsion containing suspended sand;

mechanical agitation means within said reservoir for agitating said emulsion containing suspended sand to maintain said sand in suspension;

a pump the input of which is connected to said reservoir by a supply line, said supply line including a high volume filter selected to pass said suspended sand and to block objects larger than said suspended sand; and a spray means connected to the output of said pump for spraying said emulsion containing suspended sand under pressure.

3. The apparatus of claim 2 further comprising a return line including a flow adjusting valve therein connecting the output of said pump to said reservoir for selective recirculation of said emulsion.

4. A portable fluid spraying apparatus for spraying coal-tar-pitch emulsions having a specific gravity of at least 1.20 and containing suspended sand, comprising: a frame, a cylindrical reservoir longitudinally mounted on the frame and having opposing front and rear endwalls; a rotatable elongated shaft disposed longitudinally within the reservoir between the endwalls and generally along the longitudinal axis of said cylindrical reservoir and having its opposing ends extending sealingly through the walls; a mechanical agitating means affixed to the shaft adapted to blend the contents of the reservoir; means for rotating said shaft; and a fluid pumping assembly communicating with the interior of the reservoir and with a fluid spraying means; said fluid pumping assembly including a motor driven pump having an inlet and an outlet conduit, and a high-volume fluid filter connected between the reservoir and the inlet to the pump, said filter comprising a screen including perforations selected to pass said suspended sand and to block objects larger than said suspended sand, and said outlet conduit of the pump being connected to the fluid spraying means and to the reservoir by valve and conduit means for directing a selected portion of the output of the pump to the spraying means while the remaining portion is directed back into the reservoir.

* * * * *